US006053959A

United States Patent [19]

Ireland

[11] Patent Number: 6,053,959

[45] Date of Patent: Apr. 25, 2000

[54] METHOD AND COMPOSITION FOR ALUMINUM RECYCLE USING SALT FLUX

[75] Inventor: Donald T. Ireland, Delano, Minn.

[73] Assignee: Cargill, Incorporated, Minneaplois, Minn.

[21] Appl. No.: 08/961,358

[22] Filed: Oct. 30, 1997

[51] Int. Cl.[7] ..... C22B 21/00

[52] U.S. Cl. ..... 75/309; 75/685; 75/687

[58] Field of Search ..... 73/309, 310, 685, 73/687

[56] References Cited

U.S. PATENT DOCUMENTS

| | | | |
|---|---|---|---|
| 3,840,651 | 10/1974 | Ireland | 423/499 |
| 4,761,207 | 8/1988 | Stewart, Jr. et al. | 204/67 |
| 5,405,427 | 4/1995 | Eckert | 75/308 |

FOREIGN PATENT DOCUMENTS

| | | | |
|---|---|---|---|
| 1661235 | 7/1991 | Russian Federation | 75/309 |

OTHER PUBLICATIONS

CA 118:25336—Hantelmann, H., "Complete Treatment of Aluminum Salt Slags", Tsvetn. Met. (Moscow) (1992) (6), 63–4.

Pedersen, et al., "Refining and Alloying of Aluminum by Injection", Light Metals, 1996, pp. 759–765.

Revet, Annette, "Solution Mined Chlorides as a New Source of Aluminum Flux Ingredients", Third International Symposium on Recycling of Metals and Engineered Materials, Edited by P.B. Queneau & R.D. Peterson, The Minerals, Metals & Materials Society, 1995, pp. 243–250.

Shell, et al., "Aluminum Dross Treatment Using Salt Fluxes", pp. 133–146, Alum. Cast House Tech. Australas., Asian Pac. Conf., 4th, 1995, Published The Minerals, Metals & Materials Society.

Utigard, et al., "Thermodynamic Behavior of Magnesium During Refining and Fluxing of Aluminum", Light Met. Process. Appl., Proc. Int. Symp. (1993). pp. 383–395.

Sorrell, et al., "Aluminum Fluxing Salts: A Critical Review of the Chemistry and Structures of Alkali Aluminum Halides", Information Circular 9069, United States Department of the Interior, Bureau of Mines, 1986, pp. 1–37.

Tenorio, et al., "Effect of the Saline Flux Composition on the Recycling of UBC and Aluminum Chips", Int. Conf. Recycl. Met., Proc., 2nd (1994) pp. 419–425.

Van Linden, et al., "Molten Salt Flux Composition Effects in Aluminum Scrap Remelting", Light Met., 1988, pp. 391–398.

Wojciechowski, Jr., et al., "UBC Flux Optimization at Imsamet, Inc. Aluminum Smelter", The Minerals, Metals & Materials Society, pp. 1297–1299.

Ye, et al., "Role of Molten Salt Flux in Melting of Used Beverage Container (UBC) Scrap", Third International Symposium on Recycling of Matals and Engineered Materials, Edited by P.B. Queneau & R.D. Peterson, The Minerals, Metals & Meterials Society, 1995, pp. 639–649.

Narayanan, et al., "Metal Loss in Remelting of Aluminum Alloys in Molten Salt Fluxes", Light Metals, 1995, Edited by J. Evans, The Minerals, Metals & Materials Society, pp. 803–807.

*Primary Examiner*—Melvyn Andrews
*Attorney, Agent, or Firm*—Fitch, Even, Tabin & Flannery

[57] ABSTRACT

A salt flux composition comprising a standard purity salt and additives is used in the recycle of scrap aluminum to increase the recovery of aluminum. The additives include a carbon source, an alkaline agent and a fluoride source.

28 Claims, 1 Drawing Sheet

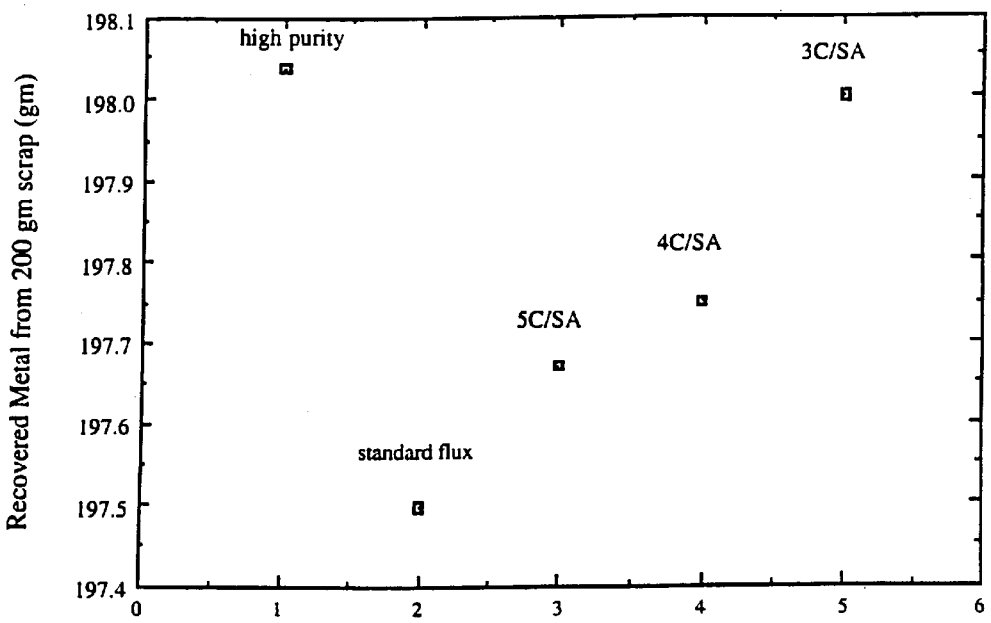
Figure 1: Recovered metal in 200 gm scrap melting in different fluxes

METHOD AND COMPOSITION FOR ALUMINUM RECYCLE USING SALT FLUX

FIELD OF THE INVENTION

This invention provides a composition and method of using that composition in the recycle of aluminum, especially scrap aluminum such as found in used beverage containers. More particularly, this invention relates to a standard purity salt flux composition and additive composition for use with a standard purity salt for making the standard purity salt flux composition, which salt flux composition can be used during the remelting of scrap aluminum. The method of the invention is directed to using the standard purity salt flux composition during the aluminum recovery process.

BACKGROUND OF THE INVENTION

Use of molten salt fluxes in the secondary aluminum industry is known to improve direct recovery of aluminum in remelting processes. Aluminum and scrap aluminum, such as used beverage containers (UBCs), are treated using such processes. Remelting of the aluminum in a furnace is carried out under cover of a layer of molten salt to prevent oxidation of the aluminum in the furnace atmosphere and to promote coalescence of the molten aluminum so as to maximize recovery of aluminum. During processing, an oxide film tends to form on the surface of the molten aluminum droplets. The oxide film inhibits coalescence of the molten aluminum, causing smaller particles to be lost in the process thereby reducing the amount of aluminum recovered. The unrecoverable aluminum droplets having the oxide film are sometimes referred to as dross.

Use of a salt flux in the furnace helps to strip away and suspend the oxide film so that coalescence of the droplets increases and dross formation decreases. The salt flux wets the oxide film and initiates disintegration of the film, stripping it from the surface of the molten aluminum droplets. Fragments of the oxide film stripped from the aluminum remain suspended in the flux. The aluminum droplets, which have a density greater than the flux, then form a continuous molten pad beneath the flux layer. The flux also prevents further oxide formation by keeping the metal protected from the atmosphere of the furnace.

A typical salt flux is primarily composed of a mixture of high purity sodium chloride and potassium chloride. The high purity salts used in such processes are solution mined and purified by complex, highly developed methods which can drive up the price of the salts. Thus, although by purification it is possible to avoid the harmful effects of sulfate impurities which are present initially in these alkali metal salts, use of high purity salts can be quite costly.

It is desirable to minimize sulfate impurities in salts because the sulfate impurities act as an oxidant which contributes to the formation of the oxide film on the surface of the molten aluminum. The film is formed according to the following reactions:

$$32/3\ Al+4CaSO_4 \rightarrow CaS+13/3Al_2O_3+Al_2S_3+3CaO$$

$$8Mg+2CaSO_4 \rightarrow 6MgO+MgS+CaO.MgO+CaS$$

The formation of film by these reactions results in metal weight loss. Additionally, the formation of oxides and sulfides increases dross formation. Thus, although a standard purity salt may be less costly then a high purity salt, aluminum recovery can be greatly reduced when a standard purity salt is used, because of the harmful effects of the sulfate impurities.

An object of this invention is to provide a low cost composition for improved aluminum recovery in a recycle process.

Another object of the invention is to provide a salt flux composition which includes a standard purity salt for use in any standard process of recycling aluminum, especially UBCs, without the harmful side effects of sulfate impurities.

Yet another object of the invention is to use a salt flux composition, which includes a standard purity salt, a carbon source, an alkaline agent and a fluoride source, in the recycle of scrap aluminum, such as UBCs, to increase the coalescence of the remelted molten aluminum, thereby improving recovery of the metal.

Further objects and advantages of the invention will be found by reference to the following specification.

DESCRIPTION OF THE DRAWING

FIG. 1 is a graph showing the amount of metal recovered using various salt flux compositions.

SUMMARY OF THE INVENTION

The present invention is directed to a method and composition for increasing aluminum recovery in the recycle of aluminum, and in an important aspect, scrap aluminum such as aluminum from used beverage containers (UBCs). The salt flux composition of the invention protects the molten aluminum from oxidation, strips a protective oxide film from the molten aluminum so that molten aluminum droplets can coalesce and holds the oxide film in suspension so that the molten aluminum can be recovered.

Broadly, the salt flux composition of the invention comprises standard purity NaCl and/or KCl, a carbon source and a fluoride source. The salt flux composition of the invention minimizes the harmful effects associated with sulfate impurities often found in standard purity salts. The amounts of carbon source and fluoride source, along with the standard purity NaCl and/or KCl, are effective for improving coalescence and reducing aluminum loss in the recovery of aluminum from molten scrap aluminum, where the improvement is relative to a salt flux composition which comprises a standard purity salt without a carbon source and a fluoride source.

In an important aspect, the invention includes a salt flux composition which comprises standard purity NaCl and/or KCl, a carbon source, an alkaline agent and a fluoride source, where the amounts of the carbon source, alkaline agent and fluoride source, along with a standard purity salt in the salt flux composition, are effective for improving coalescence and reducing aluminum loss in the recovery of aluminum from molten scrap aluminum, especially UBCs which comprise specific alloys of aluminum. Such an improvement is relative to a process using like conditions and a standard purity salt flux composition consisting essentially of a standard purity salt without the carbon source, alkaline agent and fluoride source. Generally, the salt flux composition comprises at least about 1 weight percent and preferably from about 1 to about 7 weight percent carbon source, at least about 1 weight percent and preferably from about 1 to about 3 weight percent alkaline agent and at least about 3 and preferably from about 3 to about 7 weight percent fluoride source, all based upon the weight of the salt flux composition. Generally, the salt flux composition comprises from about 83 to about 95 weight percent NaCl and/or KCl in this aspect of the invention.

Including a carbon source, an alkaline agent and a fluoride source in the salt flux composition facilitates the use of standard purity salt (NaCl and/or KCl). In an important aspect of the invention, the standard purity salt flux will have at least about 0.3 weight percent sulfate. In a very important aspect of the invention, the invention permits the use of a standard purity salt flux having at least about 0.5 weight percent sulfate yet provides increased aluminum recovery as compared to a process using a salt flux composition consisting essentially of a standard purity alkali metal salt without a carbon source, an alkaline agent and a fluoride source. The composition and process of the invention also will at least maintain or improve aluminum coalescence as compared to a process using a salt flux consisting essentially of a high purity alkali metal salt such as NaCl and/or KCl.

As previously indicated, the use of a carbon source, an alkaline agent and fluoride source obviates the need to use a high purity salt in a flux composition to obtain at least the same or better degree of aluminum coalescence as is achieved using a flux composition which consists essentially of a high or low purity salt without the carbon source, alkaline agent and fluoride source. The in situ use of a standard purity salt flux composition which includes a carbon source, an alkaline agent and fluoride source provides improved aluminum coalescence and recovery, which until now was unexpected. Furthermore, because the flux of the invention includes a standard purity salt, the cost of the flux composition is significantly reduced.

In another aspect, the invention is directed to an additive composition which comprises a carbon source, alkaline agent and fluoride source for addition to standard purity NaCl and/or KCl to provide a standard purity salt flux composition. The carbon source, alkaline agent and fluoride source in the additive are each in amounts which are effective for improving the recovery of scrap aluminum in a process which utilizes a salt flux composition which includes the additive as compared to a process which utilizes a salt flux consisting essentially of a standard purity alkali metal salt without the additive. In an important aspect, the carbon source is selected from the group consisting of coal, coke, graphite, carbon black, and mixtures thereof, the alkaline agent is selected from the group consisting of $Na_2CO_3$, NaOH, KOH, $K_2CO_3$ and mixtures thereof and the fluoride source is selected from the group consisting of MF, $CaF_2$, $MAlF_4$ $M_3AlF_6$ and mixtures thereof, where M is K or Na.

In another important aspect, the additive composition comprises carbon source in an amount of from about 13 to about 70 weight percent, alkaline agent in an amount of from about 1 to about 30 weight percent and fluoride source in an amount of from about 18 to about 78 weight percent, each based upon the weight of the additive composition. In another important aspect, the additive composition comprises between about 5 to about 16 weight percent of the salt flux composition.

The salt flux composition of the invention generally is used in the process of the invention at a level of at least about 1 weight percent, based upon the weight of aluminum being processed.

DETAILED DESCRIPTION OF THE INVENTION

Definitions

As used herein, "scrap aluminum" means aluminum stock left over from equipment or structural manufacture or used beverage cans.

As used herein, scrap aluminum from UBCs includes 3003 aluminum alloy, 3004 alloy and 5182 alloy.

As used herein, a "standard purity salt" means sodium chloride having at least about 0.3 weight percent sulfate or potassium chloride having at least about 0.02 weight percent sulfate, and a "high purity salt" means sodium chloride having less than about 0.02 weight percent sulfate or potassium chloride having less than about 0.01 weight percent sulfate.

As used herein, "standard purity salt flux composition" or "standard purity salt flux" means a flux composition which comprises a standard purity sodium or potassium chloride or a mixture thereof. A standard purity flux composition has at least about the same or greater amount of sulfate which is in standard purity NaCl, KCl or blends thereof, which is used in the standard purity flux composition.

As used herein, "additive composition" means a composition which comprises a carbon source, an alkaline agent and a fluoride source for use with an alkali metal salt to provide a salt flux composition which may be used in the recovery of aluminum from scrap aluminum.

As used herein, "high purity salt flux composition" means a flux composition comprising high purity sodium, potassium chloride or a mixture thereof, where the flux composition does not have more sulfate than high purity NaCl, KCl or blends thereof.

As used herein, "dross" means the formation of unrecoverable aluminum droplets having an oxide film covering the outer surface which are entrapped within the salt flux layer in the furnace.

As used herein, "recovery yield" means the yield of recovered aluminum metal from a recycling process where the yield of recovered aluminum is based upon the weight of the aluminum which is put into the process as a starting material.

Salt Flux Composition

The invention provides a method and compositions for enhanced aluminum recovery when scrap aluminum is processed for recycle. The invention provides a salt flux composition, which comprises standard purity NaCl and/or KCl, a carbon source, an alkaline agent and a fluoride source, to be used in a furnace during the recycle of aluminum, especially scrap aluminum such as found in used beverage containers (UBCs). The salt flux composition of the invention is melted along with scrap aluminum to provide a molten mixture in the furnace, wherein the salt flux composition promotes the coalescence of the molten aluminum droplets and prevents oxidation of the aluminum so as to increase the recovery yield of aluminum from the recycle process.

In an important aspect, the salt flux composition of the invention is used in the recovery of aluminum from UBCs comprising alloys of aluminum, such as 3003, 3004 or 5182 aluminum alloys. The UBCs also may contain up to about 2% magnesium.

The standard purity salt used in the salt flux of the present invention comprises NaCl, KCl or a mixture thereof. The standard purity salt flux will have at least as much sulfate as standard purity NaCl or KCl and in an important aspect has at least about 0.3 weight percent sulfate and may even have about 0.5 weight percent or more of sulfate yet still provide at least the same recovery yield as a high purity salt flux which includes a high purity salt having a sulfate composition of no more than about 0.02 weight percent sulfate.

Possible types of standard purity NaCl which can be used include rock salt, solar evaporated salt and mixtures thereof. Possible types of standard purity KCl which can be used include red potash, white potash and mixtures thereof.

In its broadest aspect, the salt flux composition of the invention comprises standard purity NaCl and/or KCl, a carbon source and a fluoride source. The amounts of carbon source and fluoride source, along with the standard purity NaCl and/or KCl, are effective for improving coalescence and reducing aluminum loss in the recovery of aluminum from molten scrap aluminum, where the improvement is relative to a salt flux composition which comprises a standard purity salt without a carbon source and a fluoride source. Generally, in this aspect, the salt flux composition comprises at least about 86 weight percent and preferably from about 86 to about 96 weight percent NaCl and/or KCl, at least about 1 weight percent and preferably from about 1 to about 7 weight percent carbon source and at least about 3 and preferably from about 3 to about 7 weight percent fluoride source, all based upon the weight of the salt flux composition.

In an important aspect, the salt flux composition of the invention comprises a standard purity NaCl and/or KCl, a carbon source, an alkaline agent and a fluoride source, which salt flux composition minimizes the harmful effects associated with sulfate impurities often found in standard purity salts.

In all aspects of the invention, the salt flux composition of the invention comprises between about 83 to about 95 weight percent standard purity NaCl, KCl or blends thereof. When a mixture of standard purity salts is used, the ratio of NaCl to KCl is from about 30:70 to 70:30. Preferably an essentially equimolar mixture of standard purity NaCl and KCl is used in the standard purity salt flux to provide a lower melting temperature for the standard purity salt flux composition, as well as to lower the cost of the salt flux. More particularly, it is desirable to provide a mixture of standard purity salts having a composition at or near the eutectic point of the NaCl and KCl blend so as to minimize melting temperature. It is possible, however, to use only NaCl or KCl with similar recovery results. Of course, the presence of the carbon source, alkaline agent and fluoride source in the salt flux composition also will affect the melting temperature of the salt flux composition. In an important aspect of the invention, the melting point of the salt flux composition is lower than that of aluminum to maximize the efficiency of the furnace. More specifically, the melting point of the eutectic mixture of standard purity salts is about 750° C.

The additive composition of the invention is added to a standard purity salt to provide the salt flux composition of the invention. The additive composition comprises a carbon source, alkaline agent and fluoride source in amounts effective for increasing the recovery yield of aluminum during recycle when the additive composition is added to a standard purity alkali metal salt. The additive composition comprises at least about 5 weight percent of the standard purity salt flux composition and preferably between about 5 to about 17 weight percent. In an important aspect, the additive comprises a carbon source in amount of from about 13 to about 70 weight percent, alkaline agent in an amount of from about 1 to about 30 weight percent and fluoride source in an amount of from about 18 to about 78 weight percent each based upon the weight of the additive. A preferred salt flux composition comprises about 44.5% NaCl, 44.5% KCl, 5% carbon source, 1% alkaline agent and 5% fluoride source by weight.

While not intending to be bound by any theory, the carbon source in the invention aids in the use of lower purity salt by chemically reducing sulfate. The carbon source may be either coal, coke, graphite, carbon black, or any other suitable form of elemental carbon or mixtures thereof. Preferably, coal is used as the carbon source. In an important aspect of the invention, the carbon source is finely subdivided and has a high surface area to weight ratio. A high surface area to weight ratio provides increased contact between the carbon source and sulfate to reduce the effect of sulfate impurities in the process and permit the use of lower purity salt. The carbon source is in the salt flux composition in an amount effective for reducing the effect of sulfate impurities present in a standard purity salt. Preferably, the carbon source is added in amount between about 1% to about 7% based on the weight of the salt flux composition.

While not intending to be bound by any theory, the alkaline agent in the salt flux composition of the invention, also aids in the use of lower purity salt in the salt flux and enhances the removal of sulfates. The use of alkaline agent results in an increase in pH, which enhances removal of sulfate. The alkaline agent may be either high or low bulk density soda ash, $K_2CO_3$, NaOH or KOH. Preferably, the alkaline agent is soda ash. The alkaline agent in the salt flux composition is in a amount effective for enhancing removal of sulfates. Preferably, the alkaline agent is added in an amount between about 1% to about 3% based on the weight of the salt flux composition, although use of an amount greater than about 2% provides only a limited increase in benefit.

Further, the alkaline agent, as a part of a standard salt flux composition, generally reduces the melting temperature of the flux composition. For example, the melting temperature of a salt flux without an alkaline agent was about 1212° F. When soda ash is used as the alkaline agent in conjunction with 15 weight percent soda ash in a salt flux composition, the melting temperature decreased to about 1154° F.

While not intending to be bound by any theory, the combination of carbon source and alkaline agent increases coalescence of the molten aluminum, even as compared to certain salt fluxes comprising high purity salts. Preferably, the ratio of carbon source to alkaline agent in the composition is at least about 4:1, and more preferably at least about 5:1 for improved results. Another benefit associated with the alkaline agent is that it promotes the formation of the non-reactive forms, CaO and MgO.

The fluoride source may be KF, NaF, $CaF_2$, $Na_3AlF_6$ (cryolite), $K_3AlF_6$, $NaAlF_4$ (SATF), $KAlF_4$ or mixtures thereof. Preferably, it is cryolite or SATF. While not intending to be bound by any theory, a fluoride source in the additive composition improves coalescence of the molten aluminum by increasing the dissolution of the oxide film on the molten aluminum droplets. Preferably, the fluoride source is in an amount effective for improving coalescence of the molten aluminum. More preferably, the fluoride source is present in an amount between about 3% to about 7% based on the weight of the salt flux composition. Addition of a fluoride source to the standard purity salt flux also may reduce the melting temperature of the standard purity flux composition, although its impact likely is not as great as addition of soda ash or other alkaline agent.

Method of the Invention

The method of the invention is directed to enhanced recovery of aluminum in a remelting process. If UBCs are to be recycled, pre-processing includes the mechanical shredding of the UBCs into strips of about 12 inches long and about ½ to about 1 inch wide. If other forms of aluminum are to be processed according to the method of the invention, they should be pre-processed, if necessary, to provide similarly sized particles. Preferably, the aluminum also is delacquered, if necessary. Any method known to one skilled in the art can be used to shred and to delacquer the aluminum in preparation for the remelting process.

Preferably, the components of the salt flux composition of the invention or a standard purity salt and the additive are combined to form a dry mixture prior to being charged to a furnace. The salt flux composition is charged to the furnace, such as a vertical muffle or rotary furnace or other suitable, commercially available furnace, for melting either prior to or concurrently with addition of the aluminum. The furnace should have as its melting zone a container that is relatively inert to the molten salt flux so that impurities are not introduced into the flux composition from the container. The temperature of the furnace is held between about 750° C. and about 800° C. The salt flux composition is melted at from about 740° C. to about 750° C. and may be held in the molten state for about 300 minutes. Preferably, a reducing atmosphere is maintained in the furnace to increase the rate of removal of aluminum oxide.

The shredded scrap metal then is added to the molten salt flux composition in the furnace as a batch process. The purified aluminum which has coalesced beneath the salt flux layer is decanted from the furnace after approximately 30 minutes. Generally, the recovery yield of aluminum decreases the longer the aluminum remains in the furnace. The process also may be modified for continuous processing of the scrap aluminum.

The amount of flux composition used in the furnace is at least about 1 weight percent and, in an important aspect, is from about 1% to about 50%, based upon the weight of aluminum. Preferably, the amount of flux used in the process is from about 2% to about 5% based upon the weight of the aluminum. With each batch of aluminum processed, fragments of oxide film, particles of aluminum coated with the oxide film and other impurities become entrapped in the flux composition layer, causing it to become more cloudy and viscous. The salt flux composition may be re-used in the furnace until the flux composition becomes too viscous, which makes it difficult to remove purified aluminum. Generally, the salt flux composition may be re-used approximately 6 times. After the initial charge of salt flux composition, an amount of flux composition is added to the furnace along with each batch of aluminum for each re-use of the flux composition. Approximately 5% to 15% of the total weight of flux composition initially charged to the furnace is added with each subsequent batch of aluminum.

The following example illustrates a method for carrying out the invention and should be understood to be illustrative of, but not limiting upon, the scope of the invention which is defined in the appended claims.

EXAMPLE 1

Preparation of Salt Flux Composition

| Component | Weight |
|---|---|
| NaCl | 44.5 g |
| KCl | 44.5 g |

-continued

Preparation of Salt Flux Composition

| Component | Weight |
|---|---|
| Coal | 5 g |
| Soda ash | 1 g |
| SATF | 5 g |

The above components were measured and mixed together. They were blended to provide a substantially homogeneous dry mixture.

Recycle of Scrap Aluminum

Aluminum UBCs first were pre-processed before being charged to a furnace. The UBCs were collected and put through a shredder where they were cut into strips of about ⅛ in. wide. The strips then were sent to a delacquering process to remove organic material.

A vertical muffle furnace was heated to 750° C. One hundred grams of the dry mixture of the above standard purity salt flux composition was charged to the furnace. The salt flux composition was held in the furnace for about 30 minutes to melt the mixture.

Once the salt flux composition was melted, 1900 grams of the pre-processed aluminum strips were charged to the furnace. The temperature of the furnace was maintained at 750° C. The aluminum was held in the furnace for 30 minutes before the metal pad that formed at the bottom was removed by decanting the flux layer or draining aluminum from the bottom.

The salt flux composition was left in the furnace for re-use but eventually was removed and replaced. Before processing another batch of aluminum, ten grams of the salt flux composition was added to the flux composition remaining in the furnace. One charge of salt flux composition was re-used up to six times, unless the flux composition became too viscous to effectively process the aluminum.

EXAMPLE 2

Static Coalescence Test

One hundred grams of a salt flux composition was melted at 770° C. in a crucible and held for approximately 20 minutes. The salt flux compositions tested are described in Table 1 below. Approximately 5 grams of delacquered UBC material was placed in the crucible and held in the molten salt without any agitation for approximately 15 minutes. The bottom of the crucible was inclined at a slope of approximately 20° from the horizontal to bring the molten drops in contact with each other. After approximately 15 minutes, the crucible was removed from the furnace and cooled to room temperature. The metal was recovered by dissolving the salt in water.

The salt flux compositions tested were as follows:

TABLE 1

| | High Purity Flux (weight percent) | Standard Purity Flux (weight percent) | Standard Purity Flux with Carbon Source and Alkaline Agent (weight percent) |
|---|---|---|---|
| High Purity NaCl | 47.5% | — | — |
| High Purity KCl | 47.5% | — | — |
| Standard Purity NaCl | — | 47.5% | 44.5% |
| Standard Purity KCl | — | 47.5% | 44.5% |
| Carbon Source[1] | — | — | 5% |

TABLE 1-continued

| | High Purity Flux (weight percent) | Standard Purity Flux (weight percent) | Standard Purity Flux with Carbon Source and Alkaline Agent (weight percent) |
|---|---|---|---|
| Alkaline Agent[2] | — | — | 1% |
| Fluoride Source[3] | 5% | 5% | 5% |

[1]-carbon;
[2]-soda ash;
[3]-SATF

A visual inspection of the recovered metal revealed that the standard purity salt flux, including carbon source, alkaline agent and fluoride source, provided improved coalescence in the metal as compared to the standard purity salt flux without carbon source and alkaline agent, as well as compared to the high purity salt flux.

EXAMPLE 3

Metal Recovery Test

Approximately 200 grams of a salt flux composition was melted in a crucible and maintained at about 770° C. along with approximately 200 grams of delacquered UBC material. The salt flux compositions tested are described in Table 2 below. The melt was stirred by aluminum rod for approximately 25 minutes. The crucible was removed from the furnace and cooled to room temperature. The metal was recovered by dissolving the salt in water.

The salt flux compositions tested were as follows:

TABLE 2

| | High Purity (weight percent) | Standard Flux (weight percent) | 5C/SA (weight percent) | 4C/SA (weight percent) | 3C/SA (weight percent) |
|---|---|---|---|---|---|
| High Purity NaCl | 47.5% | — | — | — | — |
| High Purity KCl | 47.5% | — | — | — | — |
| Standard Purity NaCl | — | 47.5% | 44.5% | 45% | 45.5% |
| Standard Purity KCl | — | 47.5% | 44.5% | 45% | 45.5% |
| Carbon Source[1] | — | — | 5% | 4% | 3% |
| Alkaline Agent[2] | — | — | 1% | 1% | 1% |
| Fluoride Source[3] | 5% | 5% | 5% | 5% | 5% |

[1]-carbon;
[2]-soda ash;
[3]-SATF

The results of the recovery test are shown in FIG. 1. The data points are labeled to correspond to the descriptions of the salt flux compositions in Table 2 above. The descriptions of the salt flux compositions, "5C/SA", "4C/SA", and "3C/SA", indicate the weight percent of carbon and soda ash in the flux composition, e.g., 5C/SA is 5 weight percent carbon and 1 weight percent soda ash.

The standard purity salt flux compositions which included carbon source, alkaline agent and fluoride source all provided improved metal recovery as compared to the standard purity salt flux composition without carbon source and alkaline agent.

What is claimed is:

1. A salt flux composition effective for use in the recovery of scrap aluminum comprising:

a standard purity alkali metal salt selected from the group consisting of NaCl, KCl and mixtures thereof in an amount of from about 83 weight percent;

a carbon source;

an alkaline agent; and a fluoride source, the carbon source, alkaline agent and fluoride source each in amounts effective for improving the recovery of aluminum in a process which includes the recovery of aluminum from remelted molten scrap aluminum as compared to a process which utilizes a salt flux composition consisting essentially of a standard purity alkali metal salt without the carbon source, alkaline agent and fluoride source.

2. A salt flux composition as recited in claim 1 wherein the salt flux composition comprises:

from about 1 to about 7 weight percent carbon source, based upon the weight of the salt flux composition, from about 1 to about 3 weight percent alkaline agent, based upon the weight of the salt flux composition, and from about 3 to about 7 weight percent fluoride source, based upon the weight of the salt flux composition.

3. A salt flux composition as recited in claims 1 or 2 wherein the carbon source is selected from the group consisting of coal, coke, graphite, carbon black and mixtures thereof.

4. An aluminum salt flux composition as recited in claims 1 or 2 wherein the carbon source, alkaline agent and fluoride source are present in amounts effective for improving the recovery of aluminum when the salt flux composition is mixed with molten aluminum and alkali metal salt at a level of at least about 1 weight percent based upon the weight of the molten aluminum.

5. A salt flux composition as recited in claims 1 or 2 wherein the fluoride source is selected from the group consisting of MF, $CaF_2$, $MAlF_4$, $M_3AlF_6$, and mixtures thereof where M is sodium or potassium.

6. A salt flux composition as recited in claim 3 wherein the fluoride source is selected from the group consisting of MF, $CaF_2$, MAlF4, $M_3AlF_6$ and mixtures thereof where M is sodium or potassium.

7. A salt flux composition as recited in claim 4 wherein the fluoride source is selected from the group consisting of MF, $CaF_2$, $MAlF_4$, $M_3AlF_6$ and mixtures thereof where M is sodium or potassium.

8. A salt flux composition as recited in claims 1 or 2 wherein the alkaline agent is selected from the group consisting of $Na_2CO_3$, NaOH, KOH, $K_2CO_3$ and mixtures thereof.

9. A salt flux composition as recited in claim 6 wherein the alkaline agent is selected from the group consisting of $Na_2CO_3$, NaOH, KOH, $K_2CO_3$ and mixtures thereof.

10. A salt flux composition as recited in claim 5 wherein the alkaline agent is selected from the group consisting of $Na_2CO_3$, NaOH, KOH, $K_2CO_3$ and mixtures thereof.

11. An additive composition for a salt flux, the additive composition comprising:

from about 13 to about 17 weight percent carbon source, from about 1 to about 30 weight percent alkaline agent, and from about 18 to about 78 weight percent fluoride source, the carbon source, alkaline agent and fluoride source each in amounts effective for improving the recovery of aluminum in a process which includes the recovery of aluminum from remelted molten aluminum when the additive is mixed with the molten aluminum and an alkali metal salt selected from the group consisting of NaCl, KCl and mixtures thereof, as compared to a process which utilizes a salt flux composition consisting essentially of a standard purity alkali metal salt wherein the alkali metal salt is selected from the group consisting of NaCl, KCl and mixtures thereof.

12. An additive composition as recited in claim 11 wherein the carbon source is selected from the group consisting of coal, coke, graphite, carbon black, and mixtures thereof.

13. An additive composition as recited in claims 11 or 12 wherein the fluoride source is selected from the group consisting of MF, $CaF_2$, $MAlF_4$, $M_3AlF_6$ and mixtures thereof where M is sodium or potassium.

14. An additive composition as recited in claim 13 wherein the alkaline agent is selected from the group consisting of $Na_2CO_3$, NaOH, KOH, $K_2CO_3$ and mixtures thereof.

15. A process for the recovery of aluminum from remelted molten scrap aluminum, the process comprising: melting scrap aluminum and a salt flux composition to provide a molten mixture, the salt flux comprising at least about 1 weight percent of the molten mixture based upon the weight of the aluminum and the salt flux composition comprising an alkali metal salt selected from the group consisting of NaCl, KCl and mixtures thereof, the alkali metal salt in an amount of from about 83 weight percent, based upon the weight of the salt flux composition, a carbon source, an alkaline agent and a fluoride source, the carbon source, alkaline agent and fluoride source each in amounts effective for improving the recovery of aluminum in a process which includes the recovery of aluminum from remelted molten aluminum as compared to a process which utilizes a salt flux consisting essentially of a standard purity alkali metal salt without the additive composition.

16. A process as recited in claim 15 wherein the salt flux composition comprises:

from about 1 to about 7 weight percent carbon source, based upon the weight of the salt flux composition, from about 1 to about 3 weight percent alkaline agent, based upon them weight of the salt flux composition, and from about 3 to about 7 weight percent fluoride source, based upon the weight of the salt flux composition.

17. A process as recited in claims 15 or 16 wherein the carbon source is selected from the group consisting of coal, coke, graphite, carbon black and mixtures thereof.

18. A process as recited in claims 15 or 16 wherein the fluoride source is selected from the group consisting of MF, $CaF_2$, $MAlF_4$, $M_3AlF_6$ and mixtures thereof where M is sodium or potassium.

19. A process as recited in claim 17 wherein the fluoride source is selected from the group consisting of MF, $CaF_2$, $MAlF_4$, $M_3AlF_6$ and mixtures thereof where M is sodium or potassium.

20. A process as recited in claims 15 or 16 wherein the alkaline agent is selected from the group consisting of $Na_2CO_3$, NaOH, KOH, $K_2CO_3$ and mixtures thereof.

21. A salt flux composition effective for use in the recovery of scrap aluminum comprising:

at least about 83 weight percent of an alkali metal salt selected from the group consisting of NaCl, KCl and mixtures thereof;

at least about 1 weight percent carbon source, based upon the weight of the salt flux composition, the carbon source being selected from the group consisting of coal, coke, graphite, carbon black and mixtures thereof;

at least about 1 weight percent alkaline agent, based upon the weight of the salt flux composition, the alkaline agent being selected from the group consisting of $Na_2CO_3$, NaOH, KOH, $K_2CO_3$ and mixtures thereof; and at least about 3 weight percent fluoride source, based upon the weight of the salt flux composition, the fluoride source being selected from the group consisting of MF, $CaF_2$, $MAlF_4$, $M_3AlF_6$ and mixtures thereof where M is sodium or potassium.

22. A salt flux composition as recited in claim 21 wherein the salt flux composition comprises:

from about 83 to about 95 weight percent of an alkali metal salt, based upon the weight of the salt flux composition;

from about 1 to about 7 weight percent carbon source, based upon the weight of the salt flux composition;

from about 1 to about 3 weight percent alkaline agent, based upon the weight of the salt flux composition; and from about 3 to about 7 weight percent fluoride source, based upon the weight of the salt flux composition.

23. A salt flux composition effective for use in the recovery of scrap aluminum comprising:

a standard purity alkali metal salt selected from the group consisting of NaCl, KCl and mixtures thereof in an amount of from about 83 weight percent;

a carbon source; and a fluoride source, the carbon source and fluoride source each in amounts effective for improving the recovery of aluminum in a process which includes the recovery of aluminum from remelted molten scrap aluminum as compared to a process which utilizes a salt flux composition consisting essentially of a standard purity alkali metal salt without the carbon source and fluoride source.

24. A salt flux composition as recited in claim 23 wherein the salt flux composition comprises:

an alkali metal salt selected from the group consisting of NaCl, KCl and mixtures thereof;

at least about 1 weight percent carbon source, based upon the weight of the salt flux composition, the carbon source being selected from the group consisting of coal, coke, graphite, carbon black and mixtures thereof; and at least about 3 weight percent fluoride source, based upon the weight of the salt flux composition, the fluoride source being selected from the group consisting of MF, $CaF_2$, $MAlF_4$, $M_3AlF_6$ and mixtures thereof where M is sodium or potassium.

25. A process as recited in claim 15 wherein the scrap aluminum is selected from the group consisting of 3003 aluminum alloy, 3004 aluminum alloy and 5182 aluminum alloy.

26. A process as recited in claims 15 or 25 wherein the alkali metal salt is a standard purity alkali metal salt.

27. A process as recited in claim 19 wherein the alkali metal salt is a standard purity alkali metal salt.

28. A process as recited in claim 27 wherein the scrap aluminum is selected from the group consisting of 3003 aluminum alloy, 3004 aluminum alloy and 5182 aluminum alloy.

* * * * *